US005152732A

United States Patent [19]

Sayre

[11] Patent Number: 5,152,732

[45] Date of Patent: Oct. 6, 1992

[54] PORTABLE GYM

[76] Inventor: Cotter W. Sayre, 22026 Wyandotte St., Canoga Park, Calif. 91303

[21] Appl. No.: 737,016

[22] Filed: Jul. 29, 1991

[51] Int. Cl.[5] ..... A63B 21/00

[52] U.S. Cl. ..... 482/133; 482/112; 482/142; 482/128

[58] Field of Search ..... 272/103, 109, 62, 116, 272/130, 136, 141, 142, 134

[56] References Cited

U.S. PATENT DOCUMENTS 1,904,039 4/1933 Bruder ..... 272/144
2,223,309 11/1940 Swanson ..... 272/141
3,359,802 12/1967 Sollenberger ..... 272/130
3,415,524 12/1968 Vickers ..... 272/134
3,985,354 10/1976 Scholkin ..... 272/134
4,422,635 12/1983 Herod ..... 272/96
4,674,740 6/1987 Iams ..... 272/130

*Primary Examiner*—Richard J. Apley
*Assistant Examiner*—Jerome Donnolly

[57] ABSTRACT

A lightweight, compact, and portable exercise device with built-in molded base (1), molded to accept the body, knees and feet of the user, comprising adjustable force resisters (4a) and adjustable bar (9) heights to perform a variety of different exercises. The rotating sleeve (10) prevents injury and facilitates exercises. The resistance assembly clips (14) and the molded carrying handle (15) make transport of the device easy.

1 Claim, 2 Drawing Sheets

PORTABLE GYM

BACKGROUND OF INVENTION

1. Field of Invention

This invention relates to a lightweight, portable exercise device capable of allowing the user to perform various different exercises.

2. Description of Prior Art

Heretofore lightweight, portable exercise devices have been either of the rubber band type, which offers little exercise variety and limited results, and the portable machine types, which are either too expensive, heavy, bulky, or inconvenient to use. The need for a compact, lightweight, portable, versatile, and low cost exercise device for the traveler as well as the apartment dweller or low income person concerned with physical fitness is filled by this invention.

SUMMARY OF THE INVENTION

The invention relates to an improved exercise device that uses fully adjustable force resisters to obtain results similar to the common barbell training sets.

Another object of this invention is to provide a completely portable device that simulates the feel of a full barbell training set as well as supplying the end result of increased muscle tone to the user.

A further object of this invention is to provide variable force resisters to simulate the addition or subtraction of weights while keeping the mass of the device low.

A still further object of this invention is the integration of a platform, with indentations for various body parts, for comfort and as an aid to successful completion of the exercises, for the user to lie upon, thus simulating the common weight bench.

A still further object is to provide a readily storable exercise device for users who would normally not be able to use the standard weight set and bench due to their space limitations.

A still further object of this invention is to provide a readily adjustable device to suit the needs of the different types of exercises, as well as being able to be adjusted to suit the comfort of the user.

A still further object of this invention is to provide a device that is simple to manufacture, that uses common materials, and is thus inexpensive to construct and purchase.

Still further objects and advantages of the invention will become apparent from a consideration of the ensuing description and drawings.

DESCRIPTION OF PREFERRED EMBODIMENT

Referring to FIGS. 1 and 2, an embodiment of the Portable Gym is shown.

Figure 1:
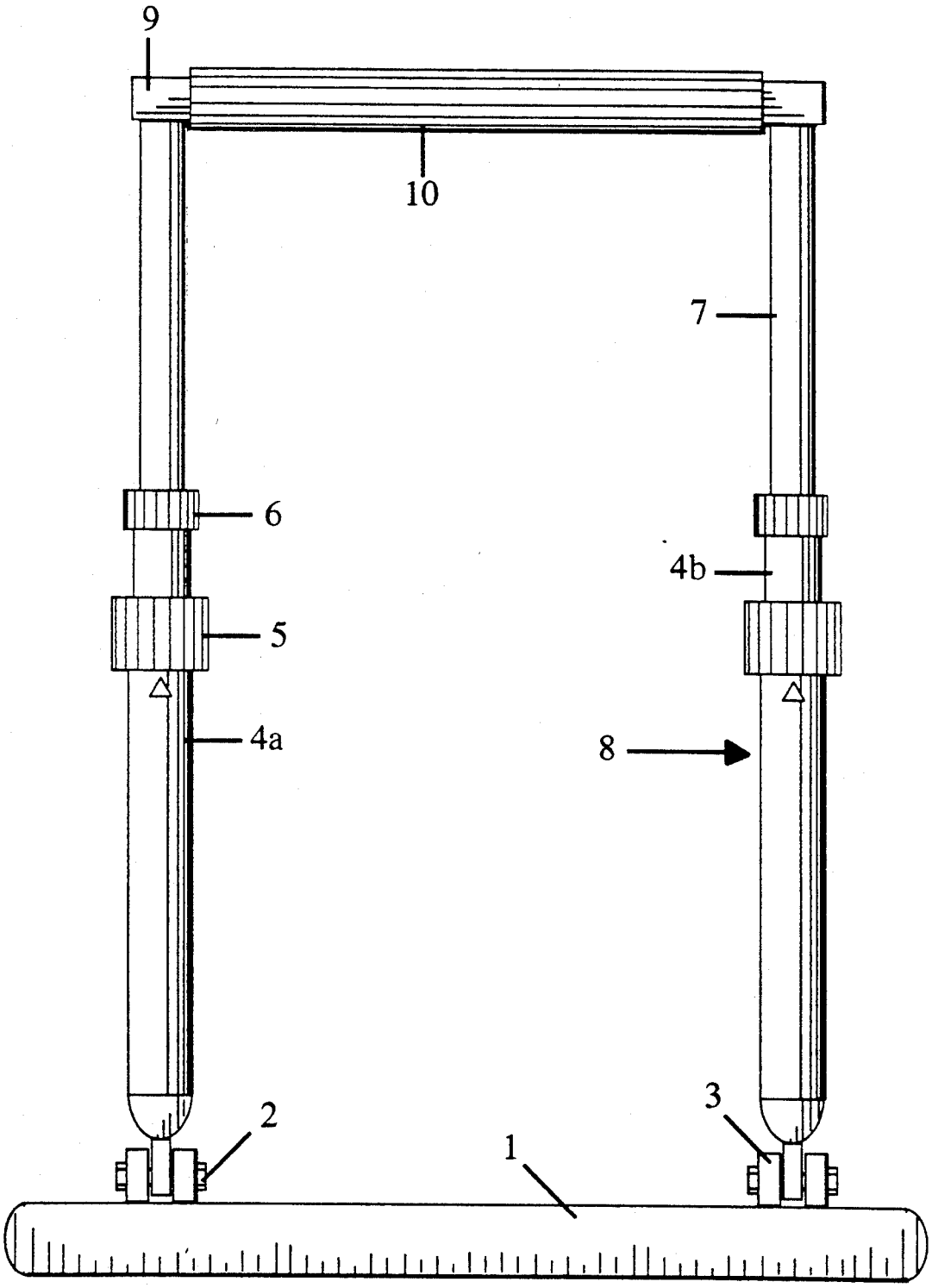
FIG. 1 is a view of the Portable Gym as it would be seen with the molded base (1) sitting on a floor and the resistance assembly (8) at a ninety degree angle to said floor.

In this embodiment, referring to FIG. 1, said molded base (1) is shown attached to the adjustable force resisters (4*a*) by a hinge pin (2) and integral hinge (3), which is molded into said molded base (1). Said adjustable force resisters (4*a*) are integrated with the force resister adjusters (5) for user control of the tension. Said adjustable force resisters (4*a*) can be either pneumatic, hydraulic, spring tension or any design for the purpose and use of said adjustable force resisters (4*a*) as are described in this embodiment and the appended claims. Attached to said adjustable force resisters (4*a*) are force resister inner sleeves (4*b*) on which the support tube tighteners (6) are located. Said support tube tighteners (6) fix the support tubes (7) in place while said support tubes (7) can slide into and out of said force resister inner sleeves (4*b*) to adjust the cross bar (9) height. Encircling said cross bar (9) is the rotating sleeve (10).

Figure 2:
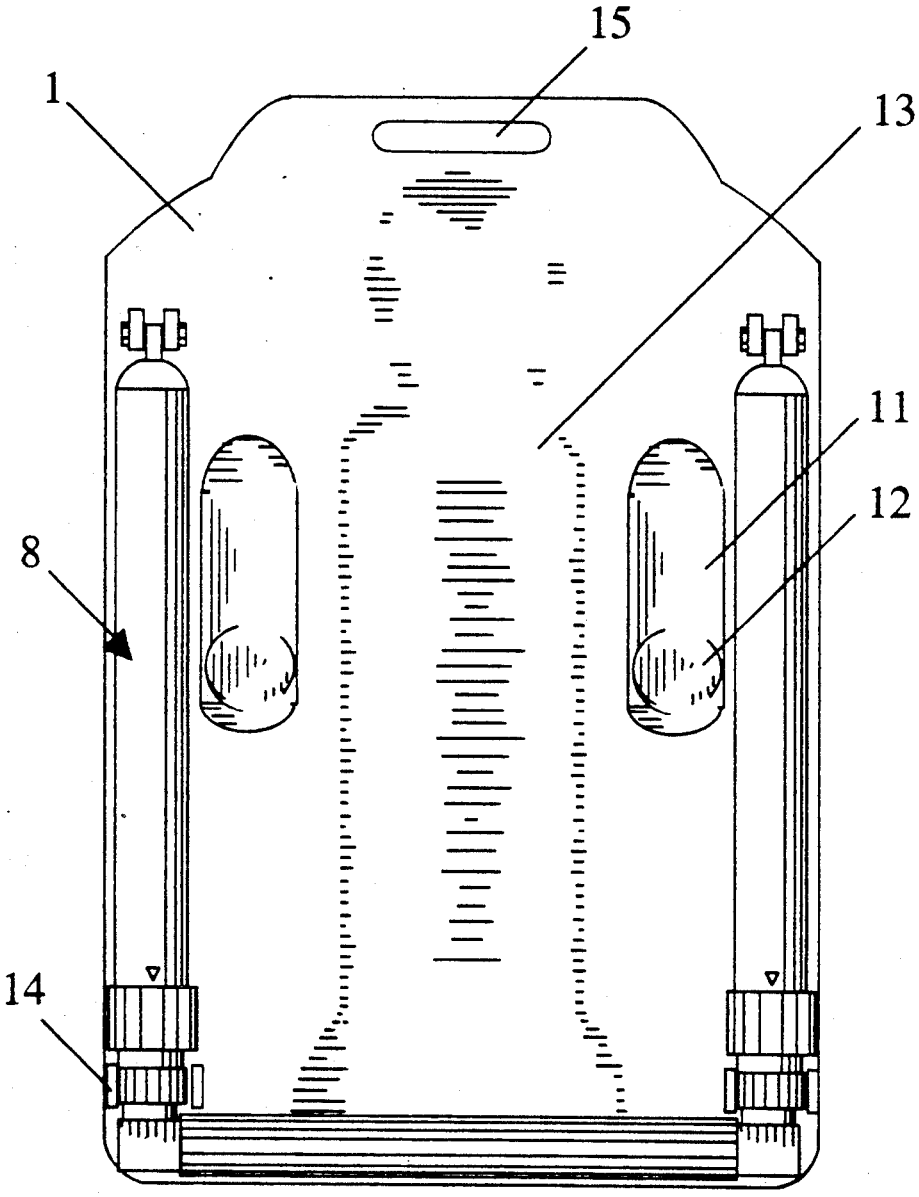
FIG. 2 is a view of the Portable Gym as it would be seen in its stored position, ready for transport.

Referring to FIG. 2, said molded base (1), constructed of plastic, rubber, or any suitable substance, containing pre-molded foot indentations (11), knee indentations (12), and body indentations (13) to aid in proper user placement. Molded into said molded base (1) is a molded carrying handle (15) for ease of transport. Also molded into said molded base (1) are resistance assembly clips (14) to secure said resistance assembly (8) during transport.

OPERATION

The manner of use of the PORTABLE GYM is as follows: Referring to FIGS. 1 and 2, the stored PORTABLE GYM is brought into use by placing the bottom of said molded base (1) flat against a level surface, with said resistance assembly (8) in the stored position (FIG. 2). The cross bar (9) is then grasped and pulled upward, thus disengaging said resistance assembly (8) from said resistance assembly clips (14). Said resistance assembly (8) is then placed 180 degrees from its stored position against the opposite side of said molded base (1). With the PORTABLE GYM in this starting configuration the following exercises can be performed:

A. Bench Press: The user lies on said molded base (1) with his body placed in said body indentation (13), raises said resistance assembly (8) to a 90 degree angle to said molded base (1), adjusts said force resister adjusters (5), extends said support tubes (7) to the users comfort and locks them in place by said support tube tighteners (6). The user then grips said cross bar (9) with said encircling rotating sleeve (10) with both hands while in the prone position and performs the standard bench press movements.

B. Arm Curls: The user places his knees in said knee indentations (12), adjusts the tension of said force resisters (4) and the length of said support tubes (7) as stated above, and grabs said rotating sleeve (10) with a underhand grip and performs the standard arm curl movements.

C. Shoulder Shrugs and Two Arm Rowing: The user places his feet in said feet indentations (11), adjusts tension and said support tube (7) length as stated above, and performs the standard shoulder shrug or two arm rowing movement.

D. Leg Extensions: The user places his body in said body indentation (13), adjusts tension and said support tube (7) length as stated above, places said cross bar (9) at his feet, and performs the standard leg extension movements.

E. Crunches: The user places his body in said body indentation (13) with said resistance assembly (8) in the stored position, and performs the standard crunch movements.

SUMMARY, RAMIFICATIONS, AND SCOPE

Thus the reader will see that the PORTABLE GYM is versatile, lightweight, compact, portable, easy to manufacture, easy to use, economical and of a simple design using standard materials.

Although the description above contains many specifications, these should not be construed as limiting the scope of the invention but as merely providing illustrations of some of the preferred embodiments of this invention. For example the molded base can have other shapes, such as circular, oval, triangular, etc.; the resistance assembly can have other shapes; the force resisters can be non-adjustable or of the rubber band type, etc.

Thus the scope of the invention should be determined by the appended claims and their legal equivalents, rather than by the examples given.

I claim:

1. A portable exercise device, consisting essentially of: a flat base molded to incorporate various body indentations having a integral molded carrying handle and integral resistance assembly clips; a set of telescoping initially-retracted force resisters attached to the base by a hinge means, said hinge means allowing forward and rearward pivoted movement of said telescoping initially-retracted force resisters; and a cross bar connected to the opposite end of said telescoping initially-retracted force resisters, said cross bar being encircled by a rotating sleeve; whereby the user is capable of performing a large number of modern exercises such as the bench press, arm curl, bent over row, shoulder shrug, squat, lateral raise, forward raise, and standard row, while lying or standing upon said flat base molded to incorporate various body indentations, as well as easily transport said exercise device with said molded carrying handle with said telescoping initially-retracted force resisters secured from movement by said resistance assembly clips.

* * * * *